US007900722B2

(12) United States Patent
Shimada et al.

(10) Patent No.: US 7,900,722 B2
(45) Date of Patent: Mar. 8, 2011

(54) ELECTRICALLY DRIVEN INDUSTRIAL VEHICLE

(75) Inventors: Yoshihide Shimada, Nagano (JP); Masao Yoshioka, Nagano (JP); Yutaka Yamazaki, Nagano (JP)

(73) Assignee: Takeuchi Mfg. Co., Ltd. (JP)

( * ) Notice: Subject to any disclaimer, the term of this patent is extended or adjusted under 35 U.S.C. 154(b) by 235 days.

(21) Appl. No.: 12/294,471

(22) PCT Filed: Mar. 9, 2007

(86) PCT No.: PCT/JP2007/055305

§ 371 (c)(1), (2), (4) Date: Sep. 25, 2008

(87) PCT Pub. No.: WO2007/116628

PCT Pub. Date: Oct. 18, 2007

(65) Prior Publication Data

US 2010/0224426 A1 Sep. 9, 2010

(30) Foreign Application Priority Data

Apr. 12, 2006 (JP) ..... 2006-110136

(51) Int. Cl.
*B62D 51/04* (2006.01)

(52) U.S. Cl. ..... 180/6.48; 180/6.7

(58) Field of Classification Search ..... 180/6.48, 180/6.7

See application file for complete search history.

(56) References Cited

U.S. PATENT DOCUMENTS 4,030,560 A * 6/1977 Parquet et al. ..... 180/6.48
4,043,416 A * 8/1977 Albright et al. ..... 180/6.48
4,074,782 A * 2/1978 Bauer ..... 180/6.48
4,209,071 A * 6/1980 Schuck ..... 180/6.48
4,220,215 A * 9/1980 Stark ..... 180/6.7

(Continued)

FOREIGN PATENT DOCUMENTS

DE 69831285 T2 11/1998

(Continued)

OTHER PUBLICATIONS

International Search Report for Application No. PCT/JP2007/055305 dated May 8, 2007.

(Continued)

*Primary Examiner* — Lesley Morris
*Assistant Examiner* — Michael R Stabley
(74) *Attorney, Agent, or Firm* — Studebaker & Brackett PC; Donald R. Studebaker

(57) ABSTRACT

A shovel loader (1) has a vehicle body frame (9), a travel device (5), a loader device (20), and a drive power generation section for generating drive power for making the travel device (5) travel. The vehicle body frame (9) has a pair of side frames (9*a*, 9*a*) arranged on both the left and right sides of the shovel loader (1). The loader device (20) is made up of a pair of lift arms (21,21) vertically swingably attached to the pair of side frames (9*a*, 9*a*) and of a bucket (29) vertically swingably attached to the forward end of the pair of lift arms (21,21). The drive power generation section has a pair of electric motors (71,71) for individually transmitting drive power to the pair of travel devices (5,5) and capable of being controlled independent of each other so that a vehicle (10) can be made to travel in a manner the left and right are independent of each other, and also has a battery (50) for supplying electric power to the electric motors (71,71).

3 Claims, 6 Drawing Sheets

U.S. PATENT DOCUMENTS

| | | | | |
|---|---|---|---|---|
| 4,962,825 | A * | 10/1990 | Albright et al. | 180/292 |
| 5,201,378 | A * | 4/1993 | Bamford | 180/6.48 |
| 5,842,532 | A * | 12/1998 | Fox et al. | 180/6.48 |
| 5,894,899 | A * | 4/1999 | Ashcroft et al. | 180/6.48 |
| 5,964,567 | A * | 10/1999 | Bamford | 414/685 |
| 6,076,619 | A * | 6/2000 | Hammer | 180/6.48 |
| 6,283,220 | B1 * | 9/2001 | Carter | 169/24 |
| 6,460,640 | B1 * | 10/2002 | Keagle et al. | 180/19.3 |
| 6,634,445 | B2 * | 10/2003 | Dix et al. | 180/6.48 |
| 6,902,016 | B2 * | 6/2005 | Bares et al. | 180/19.3 |
| 6,968,913 | B1 * | 11/2005 | Priepke | 180/6.24 |
| 7,000,724 | B2 * | 2/2006 | Lamela et al. | 180/242 |
| 7,044,258 | B2 * | 5/2006 | Lamela et al. | 180/305 |
| 7,059,434 | B2 * | 6/2006 | Bares et al. | 180/19.1 |
| 7,198,121 | B2 * | 4/2007 | Lamela et al. | 180/6.48 |
| 7,264,068 | B2 * | 9/2007 | Priepke | 180/6.24 |
| 2002/0053479 | A1 * | 5/2002 | Wakitani et al. | 180/315 |
| 2002/0104239 | A1 | 8/2002 | Naruse et al. | |
| 2003/0116936 | A1 * | 6/2003 | Felsing et al. | 280/124.166 |
| 2003/0209375 | A1 | 11/2003 | Suzuki et al. | |
| 2004/0238239 | A1 | 12/2004 | Wakitani et al. | |

FOREIGN PATENT DOCUMENTS

| | | | |
|---|---|---|---|
| DE | 10202921 | A1 | 8/2002 |
| EP | 0879920 | A2 | 11/1998 |
| EP | 1201487 | A2 | 5/2002 |
| JP | 10317429 | | 2/1998 |
| JP | 2002-137755 | | 5/2002 |
| JP | 2002-227241 | | 8/2002 |
| JP | 2005-133492 | | 5/2005 |
| JP | 2005-194845 | | 7/2005 |

OTHER PUBLICATIONS

Chinese Office Action dated Nov. 23, 2010; Chinese Patent Application No. 200780012895.9.

* cited by examiner

ELECTRICALLY DRIVEN INDUSTRIAL VEHICLE

TECHNICAL FIELD

The present invention relates to an industrial vehicle that includes a vehicle body frame fitted to a travel member having wheels, a work device provided on the vehicle body frame, and a drive power generation section provided within the vehicle body frame.

TECHNICAL BACKGROUND

An example of an industrial vehicle as described above is an industrial vehicle such as a shovel loader that is used for excavating the ground and moving the excavated soil, and so on (Japanese Patent Application Laid-open No. 2005-133492), that is provided with a vehicle body frame on a travel device, and fitted with a work device such as a bucket or arm or the like on the front end of the frame. Also, an engine room housing an engine, a radiator, an oil cooler, a hydraulic pump, a hydraulic valve, a hydraulic oil tank for storing hydraulic oil for hydraulic equipment, a fuel tank, and so on, are provided along with the engine inside the vehicle body frame. Also a counterweight is provided within the vehicle body frame to balance the weight of the work device fitted to the front of the vehicle body frame.

Problems to be Solved by the Invention

Conventionally the power source of this type of industrial vehicle was an engine, and this engine caused the vehicle to travel, and the engine drove the hydraulic pump that supplied oil pressure for driving the power shovel device, the revolving motor, and so on. However, an industrial vehicle powered by an engine generates exhaust gas and noise, so in recent years it has become desirable to use a power source other than an engine, from consideration of the effect on the surrounding environment. As an alternative to an engine as a power source, the method of using electric power to cause the vehicle to travel or to drive the hydraulic pump to operate the work device can be considered, because there is no exhaust gas and the noise is low. In this method, electric power is supplied to a device such as an electric motor to drive the hydraulic pump, so it is necessary to provide a battery on the industrial vehicle, but providing a battery on the vehicle has the following problem point. When equipment such as hydraulic pumps and electric motors are operated, the equipment generates heat, so the temperature around the battery, which is installed within the vehicle body frame together with the hydraulic pump and other equipment, increases. When the temperature around the battery increases the life of the battery is shortened, and it is necessary to minimize this effect, so the battery must be disposed so that the battery is not affected by the heat generated by the equipment. However, the space within the vehicle body frame for installation of equipment such as the hydraulic pump, the electric motor, and the battery is limited, so when the space for installation of these items of equipment is taken into consideration, it is necessary to take measures against the heat generation.

With the foregoing problem in view, it is an object of the present invention to provide an industrial vehicle having a battery as a power source instead of an engine, that is capable of minimizing the adverse effect on the surrounding environment, and that is not affected by the heat generation of equipment such as the hydraulic pump and the electric motor, disposed within the vehicle body frame.

Means to Solve the Problems

To solve the above problem, the industrial vehicle according to the present invention includes a vehicle body frame; a travel member (for example the travel device 5 in the embodiments) installed on the vehicle body frame; a work device (for example the loader device 20 in the embodiments) installed on the vehicle body frame; and a drive power generation section (for example the electric motor 71 in the embodiments) that is provided in the vehicle body frame and that generates drive power to cause the travel member to travel, wherein the vehicle body frame has a pair of side frames provided on the left and right sides of the industrial vehicle, the work device comprises a pair of lift arms (for example the arms 21 in the embodiments) vertically swingably installed on the pair of side frames at their base ends, and a bucket vertically swingably installed on the front ends of the pair of lift arms, and the drive power generation section comprises an electric motor that causes the travel member to travel by transmitting drive power to the travel member, and a battery or a large capacity condenser or a combination of a battery and a large capacity condenser that supplies electric power to the electric motor.

Also, in the industrial vehicle constituted as above, preferably the travel member comprises a pair of travel members provided on the left and right of the vehicle body frame, the electric motor is provided in the drive power generation section as a pair of left and right electric motors, and by independently controlling the drive of the pair of electric motors, the drive power can be individually transmitted to the pair of travel members and the pair of travel members can travel independently.

Also, in the industrial vehicle constituted as above, preferably the battery is housed in a battery storage part formed in a planar shape below a floor surface of the vehicle body frame.

Further, in the industrial vehicle constituted as above, preferably a battery housing aperture that opens to the battery storage part is formed in the rear surface of the vehicle body frame, and the battery is inserted and removed through the battery storage aperture.

Also, in the industrial vehicle constituted as above, preferably the battery is a lithium ion battery or an organic radical battery.

Advantageous Effects of the Invention

According to the industrial vehicle of the present invention, the vehicle is made to travel by a drive power source other than an engine, and by transmitting the rotational drive power from an electric motor that is supplied with electric power from a battery to the wheels provided on a travel device, the travel member, in other words the industrial vehicle, is made to travel. In this way, the industrial vehicle according to the present invention does not use an engine as the power source, so no exhaust gas is emitted as the industrial vehicle travels, and the noise generated is low compared with a vehicle with an engine as drive power source, so it is possible to minimize the adverse impact on the surrounding environment.

Further, the travel member includes a pair of travel members provided on the left and right of the vehicle body frame, the electric motor is provided in the drive power generation section as a pair of left and right electric motors, and by independently controlling the drive of the pair of electric motors, the drive power can be individually transmitted to the pair of travel members and the pair of travel members can travel independently, so the industrial vehicle with the electric motor as the source of drive power can be turned right or turned left, and in addition the industrial vehicle can revolve on the spot.

Also, the battery is housed in a battery storage part formed in a planar shape below a floor surface of the vehicle body frame. Then equipment that generates heat such as the hydraulic pump and the electric motor is disposed within the vehicle body frame in a position above the battery, so the heat generated by the hydraulic pump and so on, due to the operation of the hydraulic pump and so on, can be dissipated upwards within the vehicle body frame, so it is possible to minimize the effect of the heat on the battery. Here, an oil cooler with a cooling fan may be disposed within the vehicle body frame, so that if the heat from the hydraulic pump and the electric motor are dissipated to the outside of the vehicle by the oil cooler, it is possible to further reduce the effect of heat on the battery. Also, by disposing the storage position of the battery below the hydraulic pump, and so on, the freedom of arrangement of the hydraulic pump and other equipment other than the battery can be increased. Also, by inserting and removing the battery that is stored in the battery storage part of this type via a battery storage aperture that opens to the battery storage part in the rear surface of the vehicle body frame, it is possible to simplify the operation of changing the battery.

Further, by using a lithium ion battery or an organic radical battery as the battery, or using a large capacity condenser instead of the battery, or using a composite secondary battery system that includes a battery and a large capacity condenser in combination, it is possible to provide the same voltage with a smaller volume compared with a lead battery that is conventionally used as the battery of an industrial vehicle, so it is possible to reduce the space occupied by the battery within the vehicle body frame, and it is possible to increase the space provided for the hydraulic pump and the electric motor, and so on, by that amount. Also, these batteries are lighter than lead batteries, and this has the advantage that the operation of changing the battery is simplified. Either a lithium ion battery or an organic radical battery may be used as a high capacity rechargeable battery, but in particular if an organic radical battery is used, the battery can be made lighter, and can be recharged in a shorter period of time. Also, by using a composite constitution having a battery and a large capacity condenser, it is possible to reduce the voltage drop due to a sudden overload. This is effective means in the case when battery capacity of the lithium ion battery or the organic radical battery is reduced.

BRIEF DESCRIPTION OF THE DRAWINGS

FIG. 1 shows a shovel loader as an example of an industrial vehicle according to the present invention.

DESCRIPTION OF THE PREFERRED EMBODIMENTS

Figure 1A:
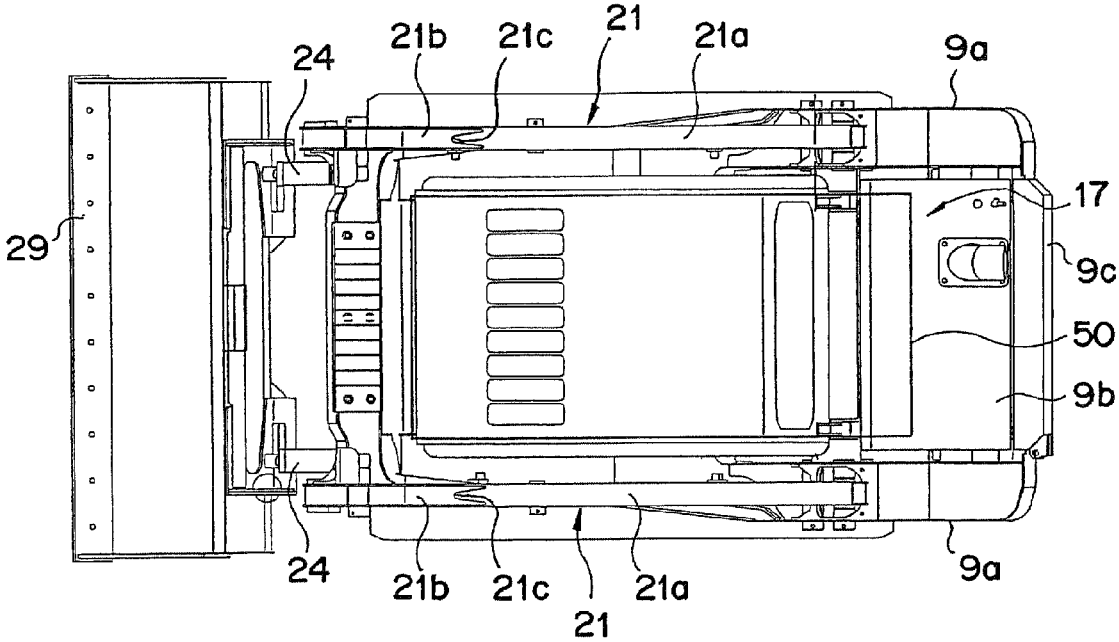
FIG. 1A is a plan view of the shovel loader.
Figure 1B:
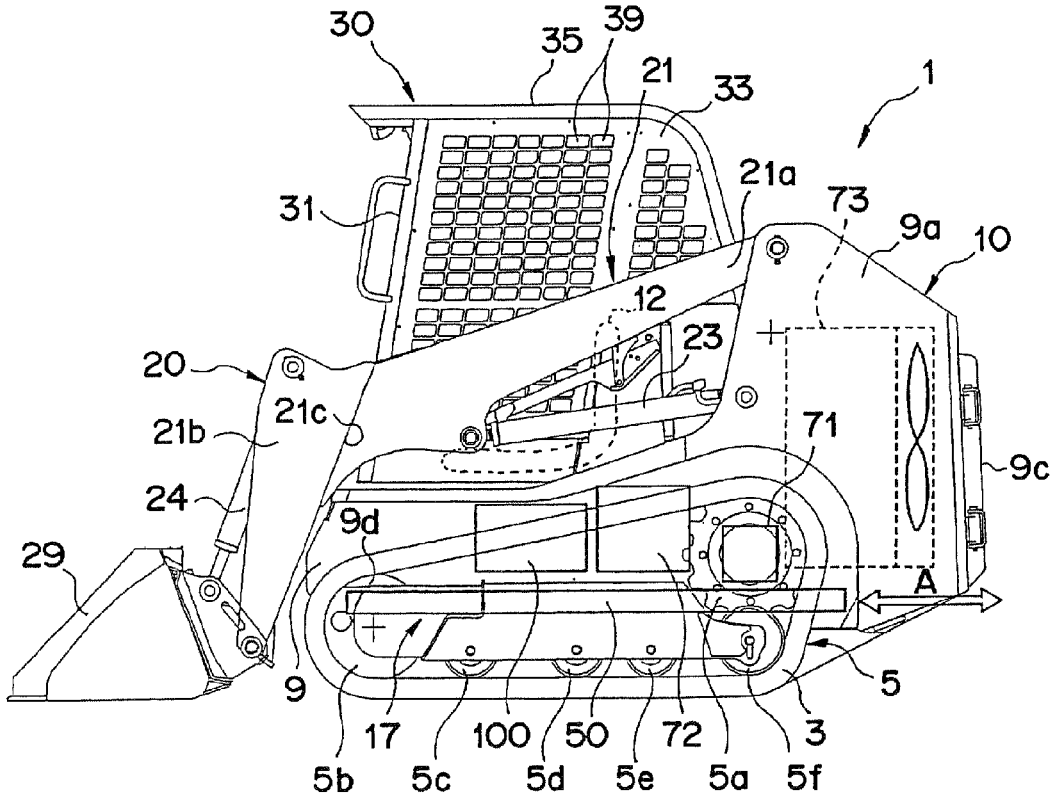
FIG. 1B is a left side view of the shovel loader.
Figure 2:
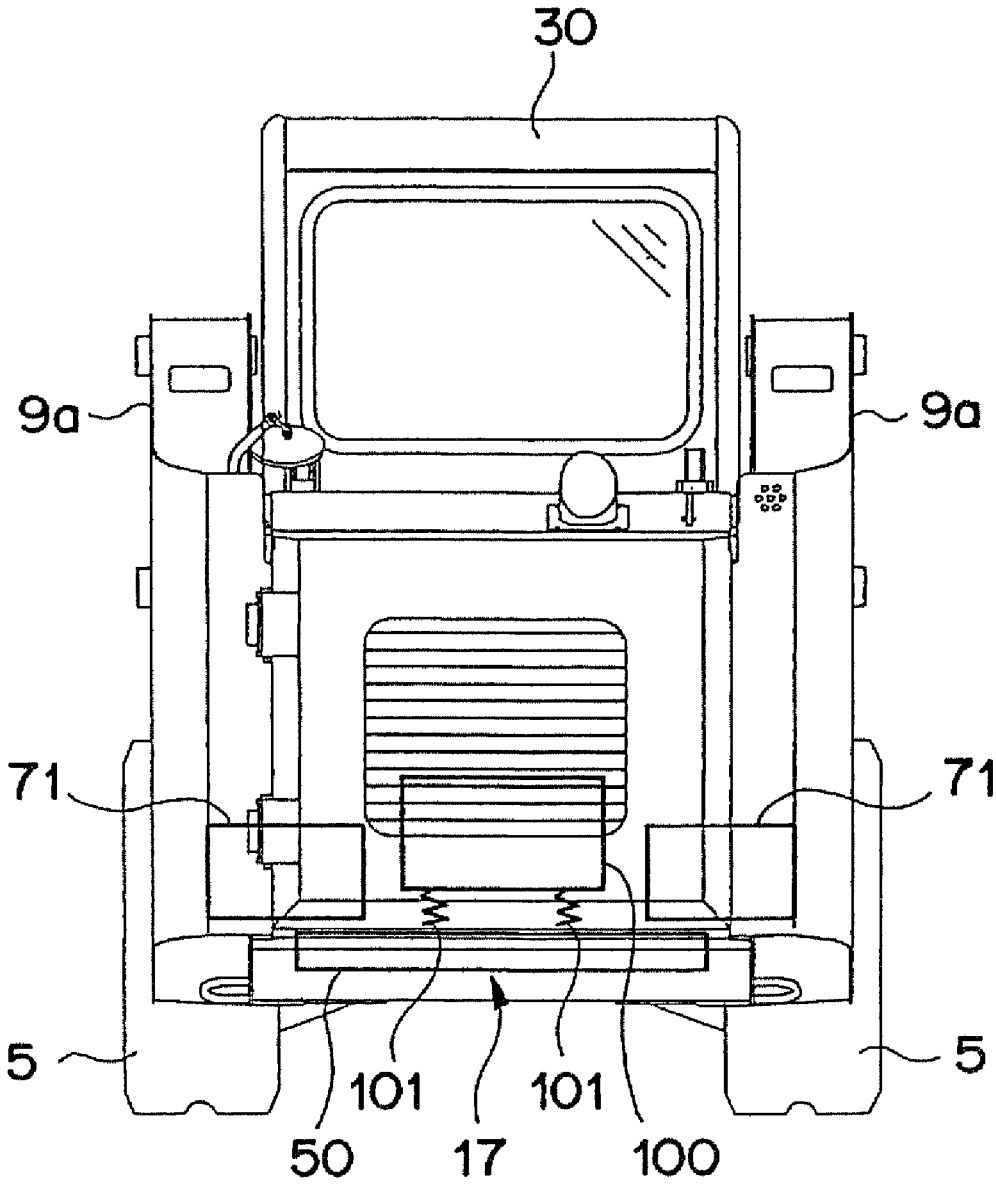
FIG. 2 is a rear view of the above shovel loader.
Figure 3:
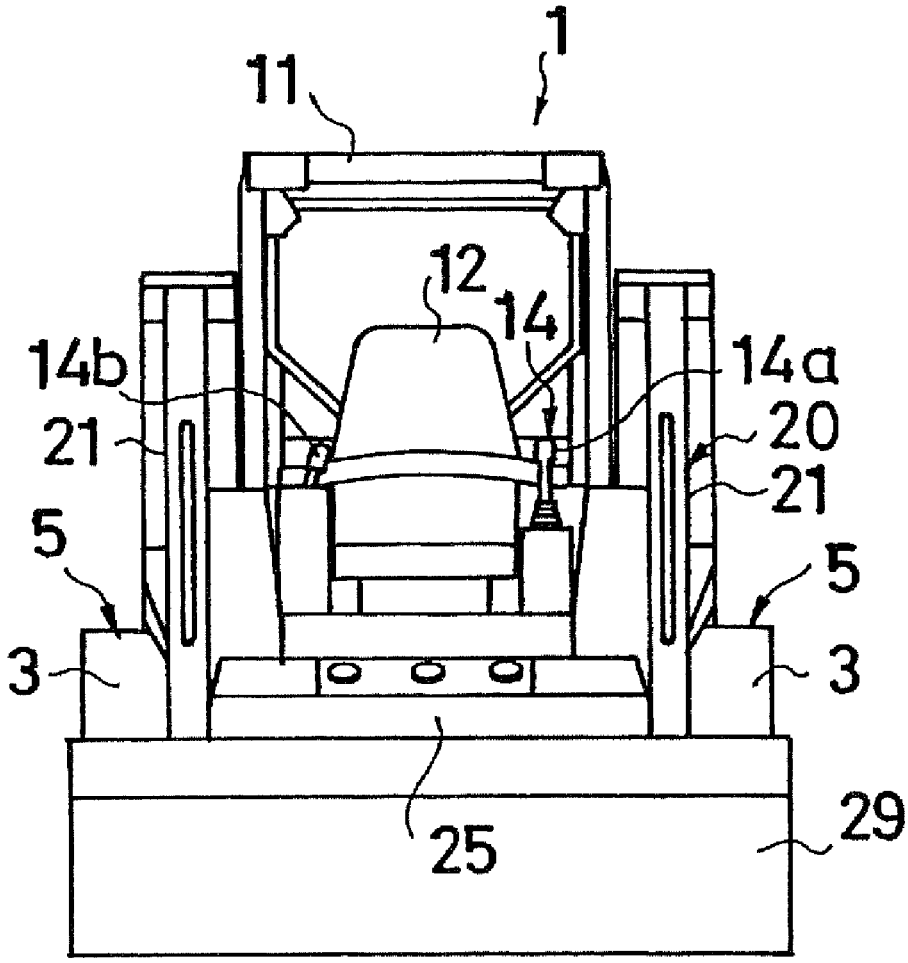
FIG. 3 is a front view of the above shovel loader.

The following is an explanation of the preferred embodiments of the present invention based on FIGS. 1 through 6. In the present embodiment, an embodiment of a shovel loader that is used for excavating the ground and moving the excavated soil, and so on, is described. First the shovel loader according to the present invention is explained. As shown in FIGS. 1 through 3, the shovel loader 1 includes a travel device 5 having crawler tracks 3, a vehicle body frame 9 having a pair of travel devices 5 installed on the left and right thereof, a loader device 20 installed on the vehicle body frame 9, and an operator's cabin 30 provided in approximately the center part in the front to rear direction of the vehicle body frame 9. Hereafter the travel devices 5 together with the vehicle body frame 9 is referred to as the "vehicle 10".

A pair of side frames 9*a* is formed projecting upwards on the left and right sides of the vehicle body frame 9. Also, besides the side frames 9*a*, the vehicle body frame 9 includes an upper frame 9*b* extending in the left-right direction between the pair of side frames 9*a* in the upper part of the rear end part of the vehicle 10, a rear frame 9*c* forming the rear end part of the vehicle 10, and a flat plate-shaped floor surface 9*d* formed below the operator's cabin 30 that can be used by an operator in the operator's cabin 30.

The loader device 20 is fitted to the side frames 9*a*. The loader device 20 includes a pair of arms 21 vertically swingably attached to the inside of the top portion of the pair of side frames 9*a*, a bucket 29 vertically swingably attached to the front ends of the pair of arms 21, and a raising and lowering cylinder 23 for raising and lowering each of the arms 21. The arm 21 includes a straight portion 21*a* that extends from the top portion of the side frame 9*a* towards the front of the vehicle, and a curved portion 21*b* that gradually curves downwards progressively from the end portion of the straight portion 21*a*, and the straight portion 21*a* and the curved portion 21*b* are integral. A step portion 21*c* is formed extending downwards between the front end of the straight portion 21*a* and the base end of the curved portion 21*b*. An end portion of the rod part of the raising and lowering cylinder 23 is swingably connected to the straight portion 21*a*, and the cylinder tube end portion of the raising and lowering cylinder 23 is swingably connected to the side frame 9*a*. Therefore when the raising and lowering cylinder 23 extends and contracts, the arm 21 is raised and lowered. The arms 21 are in the storage state when the arms 21 are lowered to the front of the vehicle extending in the front-rear direction, and with the bucket 29 tilted towards the front of the vehicle and in contact with the ground. A strengthening member 25 is fitted between the curved portions 21*b* of the pair of arms 21 extending in the left-right direction. The reinforcing member 25 is located to the front of the vehicle 10 when the arms 21 are in the storage state.

The base end of a bucket cylinder 24 is swingably attached to the base end of the curved portion 21*b* of the arms 21, and the front end of the bucket cylinder 24 is swingably attached to the base of the bucket 29. Therefore, when the bucket cylinder 24 is extended and contracted, the bucket 29 pivots vertically. In this case, when the bucket cylinder 24 is contracted, the bucket 29 pivots upwards and excavation work is performed, and when the bucket cylinder 24 is extended, the bucket 29 pivots downwards and soil discharge work is performed.

Next, the operator's cabin 30 provided in the shovel loader 1 is explained. The pair of arms 21 is disposed to the outside of the operator's cabin 30, which is disposed in approximately the center of the vehicle 10 in the front-rear direction, in the left-right direction. The operator's cabin 30 is box-shaped, and includes an open aperture portion 31 towards the vehicle front, a pair of side plate portions 33 extending in the front-rear direction and separated by a predetermined distance in the left-right direction, and a top plate portion 35 extending across the tops of the pair of side plate portions 33, and extending to the top portion of the rear end of the pair of side plate portions 33 to cover the top and the rear of the operator's cabin 30. A plurality of approximately rectangular shaped holes 39 is formed in the pair of side plate portions 33, so that the interior of the operator's cabin 30 and the exterior of the vehicle are linked via the holes 39.

An operator's seat 12 is disposed within the operator's cabin 30 so that an operator can sit facing towards the front of the vehicle. Also, an operating device 14 is disposed to the left and right of the operator's seat 12 for operating the loading device 20 (see FIG. 3). The operating device 14 includes a left operating lever 14*a* and a right operating lever 14*b*, when the left operating lever 14*a* is tilted the travel device 5 operates, and when the right operating lever 14*b* is tilted the arms 21 of the loader device 20 are raised or lowered and the bucket 29 carries out excavation work or soil discharge work. The operator's cabin 30 is vertically swingably attached so that it can pivot about the rear portion of the vehicle body frame 9. Therefore, if the front of the operator's cabin 30 is pulled upwards, the operator's cabin 30 can pivot upwards about the pivot connection position as center. When the operator's cabin 30 is pivoted upwards, a hydraulic pump 72 that is housed within the vehicle body frame 9 and is the source of power for the travel device 5 and the loader device 20, and so on, can be exposed from the top.

Figure 4:
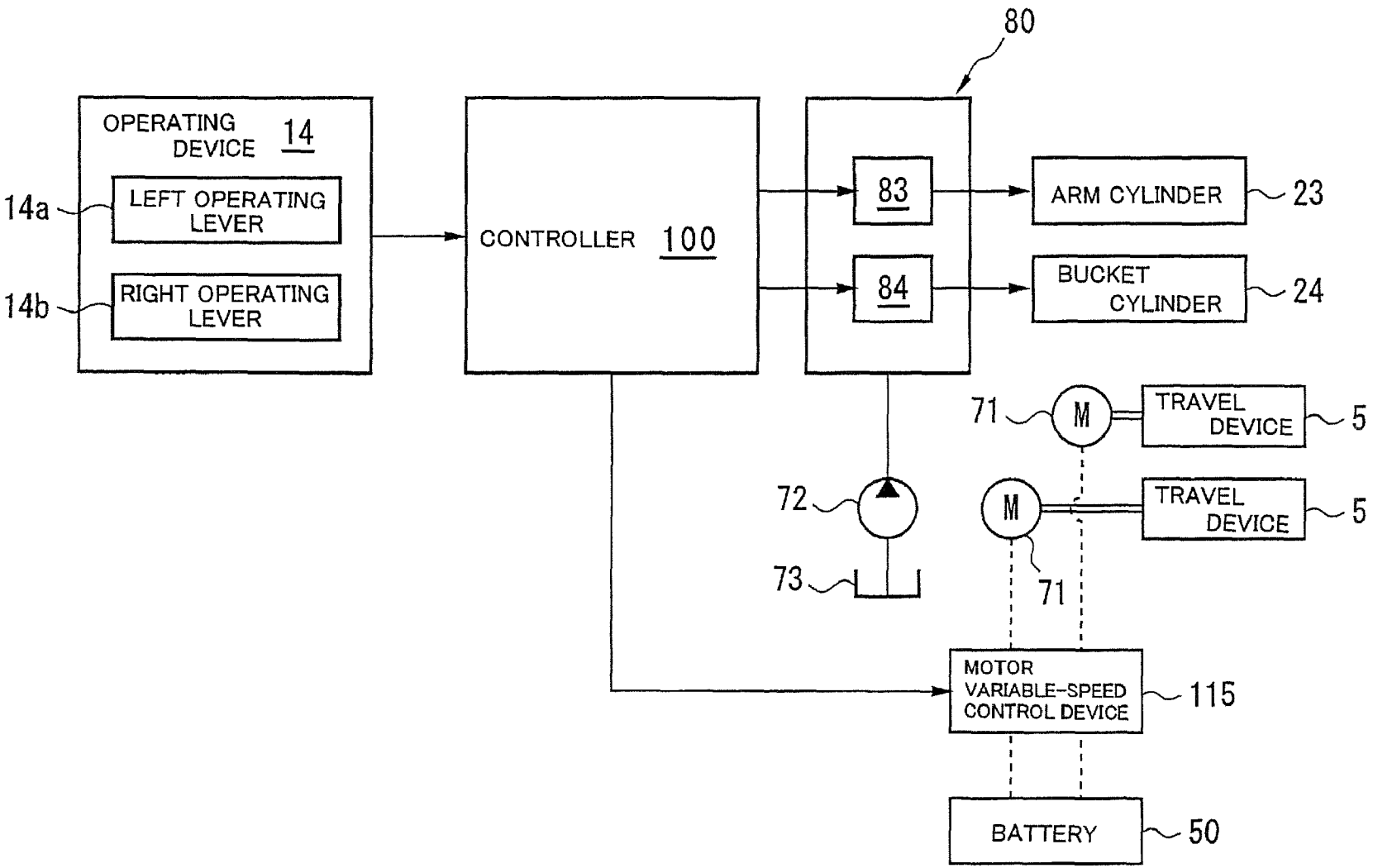
FIG. 4 is a block diagram showing the constitution of the hydraulic and other equipment provided in the above shovel loader.

As shown in FIG. 4, a controller 100 provided within the vehicle body frame 9 and that controls the overall operation of the travel device 5 and the loader device 20 receives operation signals output from the operating device 14 when the operating device 14 is operated, the controller 100 outputs control signals to a hydraulic control valve 80, and the hydraulic control valve 80 controls the supply and discharge of hydraulic oil to the arm cylinders 23 and so on, based on the control signals from the controller 100. When control signals are output from the controller 100, the hydraulic control valve 80 controls the supply and discharge of hydraulic oil output from the hydraulic pump 72 that is driven by a motor that is supplied with electric power, and the arms 21 are raised or lowered, and the bucket 29 is operated.

The hydraulic control valve 80 includes an arm control valve 83 corresponding to the arm cylinder 23 that raises and lowers the arms 21, and a bucket control cylinder 84 corresponding to the bucket cylinder 24 that operates the bucket 29. Also, control of the supply and discharge of hydraulic oil flowing to the arm cylinder 23 and so on is carried out by controlling the amount of opening of the arm control valve 83 and the bucket control valve 84 in the hydraulic control valve 80. Also, control signals output from the controller 100 corresponding to the operation of the operating device 14 are output to a motor variable speed control device 115, when control signals are output from the controller 100 to the motor variable speed control device 115, the rotation speed of an electric motor 71 is varied, and the electric motor 71 is controlled to output the appropriate torque, so that the travel speed of the travel device 5 can be freely varied.

Here, an example of the arrangement of various types of equipment within the vehicle body frame 9 is explained. Below the operator's seat 12 and within the space covered by the pair of side frames 9*a*, the upper frame 9*b*, and the rear frame 9*c*, equipment such as the electric motor 71 and the hydraulic pump 72, which are the power source for operating the travel device 5 and the loader device 20, are disposed. Among this equipment, the pair of left and right electric motors 71, 71 that are supplied with electric power from a battery 50 are arranged sideways in the left-right direction (arranged so that the long direction of the motor shaft coincides left-right direction of the vehicle 10) in both the left and right sides of the rear portion within the vehicle body frame 9 (see FIG. 2). The electric motors 71 are both induction motors, supplied with an alternating current voltage by inverters provided in the controller 100. When an alternating current flows in the windings of the stator of the electric motors 71*a* rotating magnetic field is generated, and the rotor is rotated by the interaction with the induction current generated in the rotor, so it is possible to vary the rate of rotation using the motor variable speed control device 115.

The electric motor 71 is not limited to the case that it is constituted by an induction motor, but the electric motor 71 may also be constituted by an interior permanent magnetic (IPM) motor, or a servo motor. An IPM motor is a type of reluctance motor with rare earth permanent magnets embedded within the interior of the stator (iron), and high efficiency (output is high relative to the electric power supplied) can be achieved by using the torque generated by the attraction and repulsion force between the permanent magnets and the stator, and the attraction and repulsion force between the rotor and stator. When the electric motor 71 is constituted by a servo motor, it is possible to measure the angle of the rotation shaft of the electric motor 71 by including measurement means such as a resolver or encoder, and by varying the voltage applied to the electric motor 71, it is possible to finely control the rotation speed of the rotation shaft of the electric motor 71.

As described above, by providing a pair of left and right electric motors 71 within the vehicle body frame 9, and by supplying each motor 71, 71 individually with electric power from the battery 50 under the control of the controller 100, it is possible to independently control the rotation of the left and right electric motors 71, 71. By independently controlling the rotation of the left and right electric motors 71, 71 in this way, it is possible to drive only one of the travel devices 5 fitted to the left and right of the vehicle body frame 9, for example the travel device 5 on the left side, so that the vehicle 10 can be made to revolve. Preferably reduction gears are provided connected to the output shaft of the electric motor 71, and the travel device 5 is driven via the reduction gears. As a result of this, the size of the electric motor 71 can be reduced.

The hydraulic pump 72, which supplies pressurized hydraulic oil for driving the arm cylinder 23, the bucket cylinder 24, and other hydraulic equipment, and which is driven by the electric motors 71, 71, is installed to the front of the electric motors 71, 71. A hydraulic oil tank 73 that stores hydraulic oil for operating the hydraulic equipment is disposed to the rear of the electric motor 71 in the rear end portion within the vehicle body frame 9 close to the rear frame 9*c*.

A battery storage part 17 is formed in a flat shape below the floor surface 9*d* of the vehicle body frame 9, and the battery 50 is housed in the battery storage part 17. The equipment that generates heat, such as the electric motor 71 and the hydraulic pump 72 are disposed in positions above the battery 50 within the vehicle body frame 9, so heat generated by the hydraulic pump 72 by operation of the hydraulic pump 72 is dissipated upwards within the vehicle body frame 9, so it is possible to minimize the effect of the heat on the battery 50. By providing an oil cooler with a cooling fan within the vehicle body frame 9, so that the heat from the hydraulic pump and the electric motor is released outside the vehicle 10, it is possible to further reduce the effect of the heat on the battery 50. Also, by placing the storage position of the battery 50 below that of the hydraulic pump 72 and other equipment, it is possible to increase the freedom of arrangement of the hydraulic pump 72 and other equipment apart from the battery 50.

The battery 50 is a high capacity rechargeable lithium ion battery or an organic radical battery, that can be removed from or inserted into the vehicle 10 in the front-rear direction (in the direction of the arrow A) using a slide mechanism 60 that is described later. Also, the battery 50 is disposed flat in a position below the floor surface 9*d* of the vehicle body frame 9, so it is possible to lower the position of the center of gravity of the vehicle 10, and improve the stability. Also, the battery 50 is disposed in a planar shape, so the heat dissipation area is greater than if arranged in a rectangular parallelepiped shape, so it is possible to effectively dissipate the heat generated by the battery 50 itself.

Also, in particular, in the organic radical battery referred to above, organic radical material, which is a type of thermoplastic resin, is used as the positive electrode material. The characteristics of organic radical batteries include a higher capacity than lithium ion batteries, and the electrochemical reaction speed is higher, so the recharging time is shorter. Also, unlike lithium ion batteries, organic radical batteries do not use heavy metal oxides such as lithium cobalt oxide or lithium manganese oxide as the electrodes, so they are lighter and the impact on the environment is lower.

Further, instead of the battery 50 as the electric power source for the electric motor 71, a large capacity condenser, which is not shown on the drawings, may be used. Also, a secondary battery system may be used having a composite constitution with a combination of the battery 50 and a large capacity condenser, which is not shown in the drawings, by connecting the battery 50 and the large capacity condenser in parallel. By using the composite constitution of the battery 50 and the large capacity condenser, as described above, it is possible to minimize the reduction in voltage due to a sudden overload. This an effective means when the battery capacity of the lithium ion battery or the organic radical battery is reduced.

The arrangement of the battery 50 within the vehicle body frame 9 is not limited to the planar arrangement as described above, and the batteries 50 may be formed stacked so that the overall shape is rectangular parallelepiped. In this case, the weight balance of the vehicle 10 and the dissipation of heat from the equipment must be considered, the rectangular parallelepiped battery 50 is preferably disposed for example near the rear frame 9*c*, in other words disposed in the position where the hydraulic tank 73 is disposed in FIG. 1B, and the other equipment such as the electric motor 71 and the hydraulic pump 72 is preferably disposed facing sideways aligned in the left-right direction of the vehicle 10 in a position above the battery 50.

The controller 100 that controls the overall operation of the loader device 20 is provided to the front of the hydraulic pump 72 above the battery 50. As stated above, the controller 100 receives operation signals based on the operation of the operating device 14, and outputs control signals to the hydraulic control valve 80. The hydraulic control valve 80 controls the supply and discharge of hydraulic oil to the arm cylinder 23 and the like based on the control signals from the controller 100, so it is possible to raise and lower the arms 21. By swiveling the operator's cabin 30, it is possible to expose the controller 100 and carry out changing operations.

The controller 100 includes an amplifier and other electronic equipment, so the controller 100 is particularly weak against vibrations, therefore in order to prevent faulty operation of the controller 100 caused by vibrations due to operation of the travel device 5 or the loader device 20, an elastic member 101 that absorbs vibrations, such as for example vibration prevention rubber (of course a member such as a spring may also be used) is installed.

The power source of the travel device 5 is the electric motor 71 as described above, and the travel device 5 is driven by transmission of the drive power of the electric motor 71, which causes the vehicle 10 to travel. A sprocket 5*a* on which the crawler tracks 3 are wound and which is positioned on the same axis as the rotation shaft of the electric motor 71 rotates together with the electric motor 71 and drives the crawler tracks 3. The travel device 5 includes a plurality of driven wheels, a driven wheel 5*b*, a driven wheel 5*c*, a driven wheel 5*d*, a driven wheel 5*e*, and a driven wheel 5*f* in that order from the front towards the rear of the vehicle 10, and the crawler tracks 3 are wound around the driven wheels 5*b* through 5*f* together with the sprocket 5*a*. When the crawler tracks 3 are driven by the rotation of the sprocket 5*a*, the driven wheels 5*b* through 5*f* rotate, so it is possible to cause the vehicle 10 to travel forward or backward corresponding to the direction of rotation of the electric motor 71 (forward or reverse) (in accordance with the direction of rotation of the sprocket 5*a*) based on the manipulation of tilting the left operating lever 14*a*.

As stated above, the pair of electric motors 71, 71 is provided in the left and right of the vehicle 10, and it is possible to control and drive the left and right independently, so the drive power of the electric motors 71, 71 is transmitted individually to the pair of travel devices 5, 5, and it is possible for the travel devices 5, 5 to travel independently. In this way, it is possible to vary the drive speed to the travel device 5 on the left and right, and it is possible to drive only one of the pair of travel devices 5 on the left or right. Here, if the drive speed of the travel device 5 is different on the left and right, the vehicle 10 can turn to the left or turn to the right, also, if only one of the travel devices 5 on the left or right is driven, the vehicle 10 can rotate on the spot in a plane either clockwise or counterclockwise.

Further, in the present embodiment, the travel device 5 is a crawler that includes the crawler tracks 3 wound around the sprocket 5*a* and the driven wheels 5*b* through 5*f*, but the travel device is not necessarily limited to this, and a constitution in which the electric motor 71 is provided as the power source and a plurality of rotational drive wheels to which the drive power of the electric motor 71 is transmitted is provided on the left and right of the vehicle 10 may be used. Also, when a plurality of wheels is used as the drive device, by controlling and driving the pair of electric motors 71, 71 independently, turning left and right and revolving clockwise and counterclockwise on the spot may be carried out, as described above.

Figure 5A:
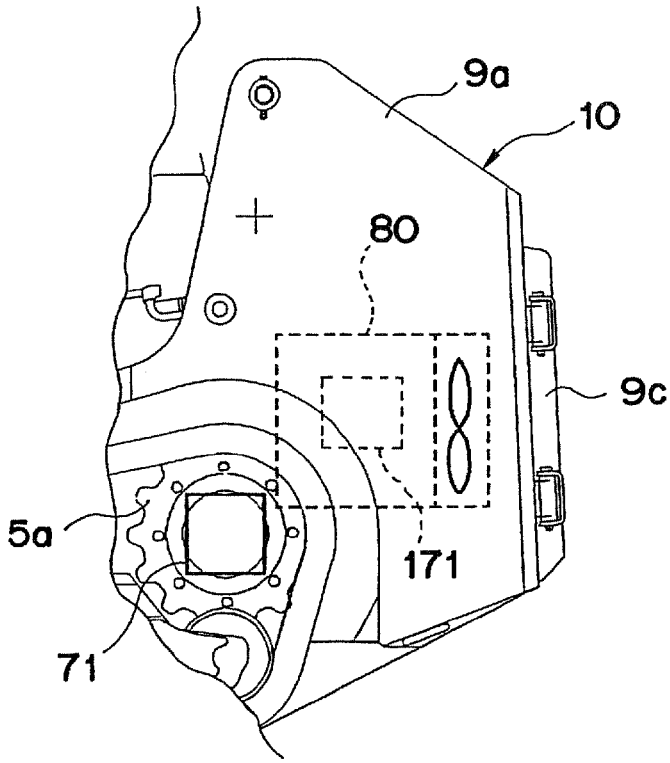
FIG. 5A is a left side view showing a part of the shovel loader to show an example of the arrangement of the electric motor and so on in the shovel loader.
Figure 5B:
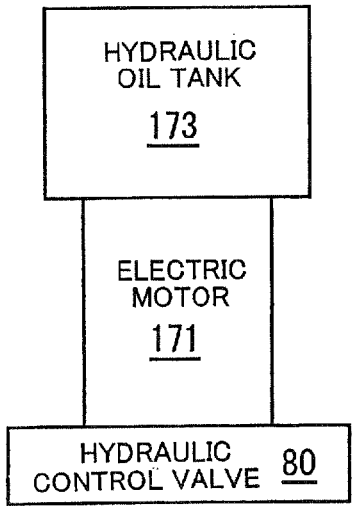
FIG. 5B is a diagram schematically showing the electric motor and so on arranged in a line in the left-right direction of the shovel loader.

As shown in FIGS. 5A and 5B, an electric motor 171 for driving the loader device 20, in other words for driving the hydraulic pump 72, may be disposed in the rear part of the vehicle 10 (to the front of the rear frame 9*c*) separately from the electric motor 71 for driving the travel device 5. With this type of arrangement, as shown in FIG. 5B, the hydraulic control valve 80, which controls the supply and discharge of hydraulic oil to the arm cylinder 23 and so on based on control signals from the controller 100 which includes a revolving drive control valve and the like, is provided in the left hand side of the vehicle 10 adjacent to the electric motor 171. Also, a hydraulic oil tank 173 that stores hydraulic oil for operating the loader device 20 is provided in the right hand side of the vehicle 10 adjacent to the electric motor 171. In other words, in the rear portion of the vehicle 10, the hydraulic control valve 80, the electric motor 171, and the hydraulic oil tank 173 are arranged in a line from the left side to the right side of the vehicle 10 in that order.

Figure 6:
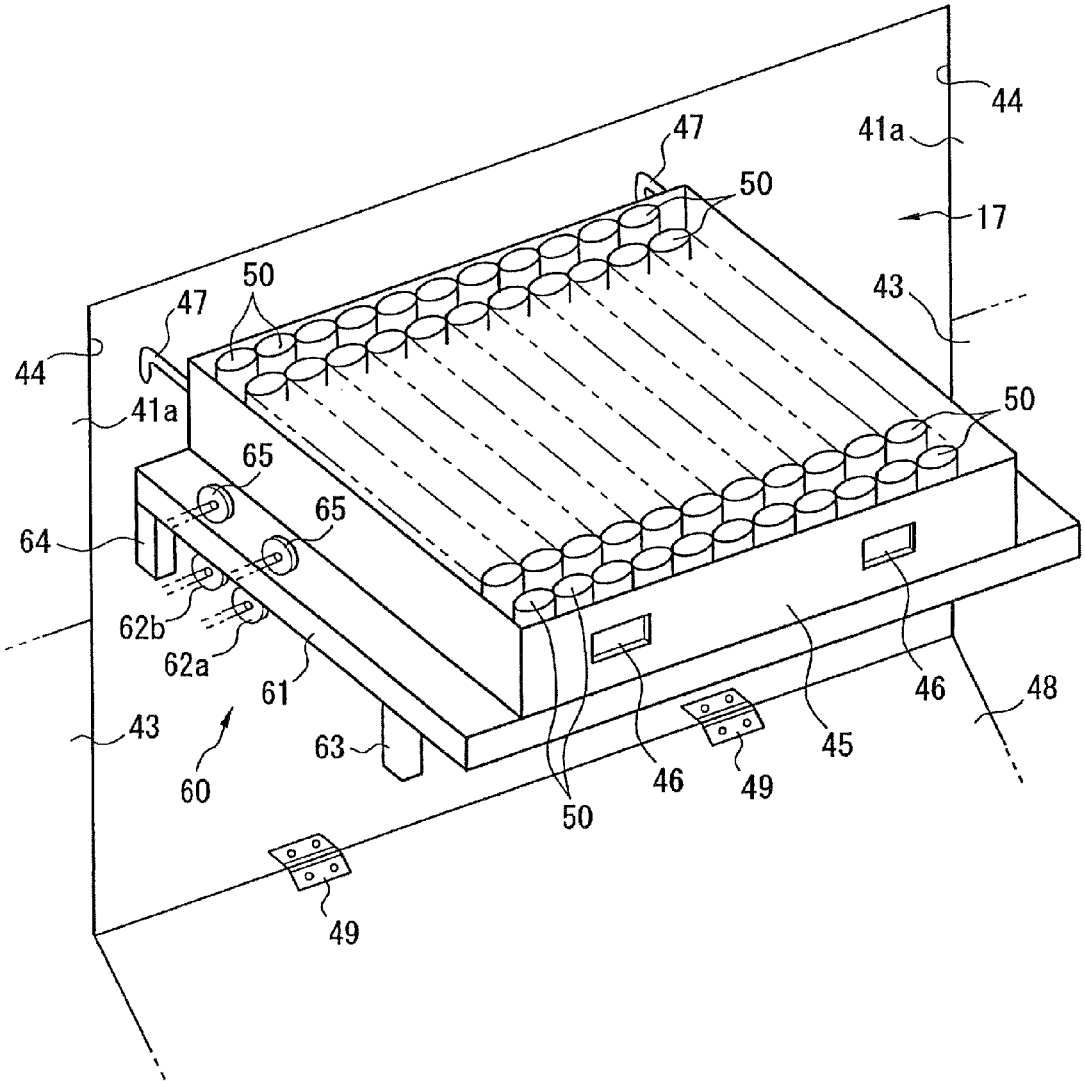
FIG. 6 is an isometric diagram showing the area around the battery storage part that houses the battery provided in the above shovel loader.

Here, referring to FIG. 6, the area around a battery storage aperture 44 for taking the battery 50 out of the vehicle body frame 9 is explained. In the rear end of the vehicle 10, the battery storage aperture 44 as shown in FIG. 6 is formed, the battery storage aperture 44 can be opened by swiveling a storage lid 48 that is capable of being swiveled vertically by hinges 49, 49 disposed to the left and right of the bottom end of the aperture of the battery storage aperture 44, in the downward direction (the storage lid 48 may also swivel vertically about hinges 49 provided in the top end of the aperture of the battery storage aperture 44). Also, by withdrawing or inserting the battery 50 in the front-rear direction via the battery storage aperture 44 with the battery storage aperture 44 in the open state, it is possible to remove or insert the battery 50 with respect to the battery storage part 17, which is covered by a lower cover 43.

As shown in FIG. 6, a pair of grips 46, 46 that an operator can grip with their hands is formed on the left and right of the front surface of a box-shaped drawer 45 that is open to the top that is a battery case for storing the battery 50. A plurality of cylindrical-shaped batteries 50, 50, . . . is disposed upright within the drawer 45 and aligned left-right and front-rear filling the interior of the drawer 45. Also, hook-shaped lock levers 47, 47 that are capable of being latched to level latching portions, which are not shown in the drawings, provided in the battery storage part 17 are installed on the left and right of the rear end surface of the drawer 45, each extending in the front-rear direction. The lock levers 47 are linked to lock release portions, which are not shown in the drawings, provided in the grips 46, so that the lock levers 47 can be latched and released by operation of the lock release portions.

The battery 50 is a lithium ion battery or an organic radical battery, as described above, having the same voltage but a smaller volume compared with lead batteries that are conventionally used as the battery of industrial vehicles, so it is possible to make the space occupied by the battery smaller, so it is possible to provide a larger space for arrangement of the hydraulic pump and the electric motor, and so on, by this amount. Further, lithium ion batteries and organic radical batteries are lighter than lead batteries, so they have the advantages that it is possible to simplify the work of changing the batteries, and the charging time is shorter.

The slide mechanism 60 for moving the box-shaped drawer 45 that houses the battery 50 in the front-rear direction is constituted as follows. The slide mechanism 60 is provided on both sides of the drawer 45 (in FIG. 6, only the slide mechanism 60 provided on the left side of the drawer 45 is shown), and includes a beam-shaped rail 61 that extends front to rear substantially horizontally; a pair of front-rear rollers 62*a*, 62*b*, the axis of the center of rotation thereof is installed in the direction of the left-right axis of the interior of the vehicle body frame 9, that rotate in the front to rear direction while contacting the bottom surface of the rail 61; a pair of front-rear rollers 65, 65, the axis of the center of rotation thereof is installed in the direction of the left-right axis of the interior of the vehicle body frame 9, that rotate in the front to rear direction while contacting the top surface of the rail 61; a column-shaped front stopper 63 provided extending vertically at the front end of the rail 61; and a column-shaped rear stopper 64 provided extending vertically at the rear end of the rail 61. The slide mechanism 60 provided on the right side of the drawer 45 is also constituted with a rail 61 and so on, as described above.

Here the maintenance of the battery 50 stored in the battery storage part 17 constituted as described above is explained. Battery maintenance as discussed here means changing the battery 50. The maintenance of the battery 50 is carried out with the storage lid 48 opened and swiveled downwards, by the operator placing the hands in the grips 46 provided in the drawer 45, carrying out the release operation of the lock levers 47 using the lock release portions, and pulling the drawer 45 forward until the front surface of the rear stopper 64 contacts the roller 62*b*. At this time, the battery 50 is exposed from the battery storage part 17, so the operation of changing the battery 50 can be carried out. Each of the rails 61, 61 are sandwiched between the rollers 62*a*, 62*b* on the lower side and the rollers 65, 65 on the top side, so the pulled out drawer 45 will not be pulled out from the vehicle 10 by the operator pulling the grips 46.

After the operation of changing the battery 50 is finished, the drawer 45 is pushed into the battery storage part 17 until the rear surface of the front stopper 63 contacts the roller 62*a*, with the hands on the grips 46. When the front stopper 63 contacts the roller 62*a*, the hook-shaped lock levers 47 latch with the lever latching portions, which are not shown in the drawings, the drawer 45 is locked so that it cannot be pulled forward. Then, the storage lid 48 is swiveled upwards and the battery storage aperture 44 is closed, which completes the series of maintenance operations, so it is possible to proceed to excavation work, or the like.

What is claimed is:

1. An industrial vehicle, comprising: a vehicle body frame; a travel member installed on the vehicle body frame; a work device installed on the vehicle body frame; and a drive power generation section that is provided in the vehicle body frame and that generates drive power to cause the travel member to travel, wherein the vehicle body frame has a pair of side frames provided on the left and right sides of the industrial vehicle, the work device comprises a pair of lift arms vertically swingably installed on the pair of side frames at their base ends, and a bucket vertically swingably installed on the front ends of the pair of lift arms, the drive power generation section comprises an electric motor that causes the travel member to travel by transmitting drive power to the travel member, and a battery or a large capacity condenser or a combination of a battery and a large capacity condenser that supplies electric power to the electric motor, the battery being housed in a battery storage part formed in a planar shape below a floor surface of the vehicle body frame, and a battery housing aperture that opens to the battery storage part is formed in the rear surface of the vehicle body frame, and the battery is inserted and removed through the battery storage aperture.

2. The industrial vehicle according to claim 1, wherein the travel member comprises a pair of travel members provided on the left and right of the vehicle body frame, the electric motor is provided in the drive power generation section as a pair of left and right electric motors, and by independently controlling the drive of the pair of electric motors, the drive power can be individually transmitted to the pair of travel members and the pair of travel members can travel independently.

3. The industrial vehicle according to claim 1, wherein the battery is a lithium ion battery or an organic radical battery.

* * * * *